US005795240A

United States Patent [19]

Chappell

[11] Patent Number: 5,795,240

[45] Date of Patent: Aug. 18, 1998

[54] MECHANICAL LOCKING DEVICE FOR ATTACHING A SHAFT TO A GOLF CLUB HEAD

[75] Inventor: Chris Chappell, Westminster, S.C.

[73] Assignee: Dunlop Maxfli Sports Corporation, Westminster, S.C.

[21] Appl. No.: 710,581

[22] Filed: Sep. 19, 1996

Related U.S. Application Data

[62] Division of Ser. No. 480,556, Jun. 7, 1995, Pat. No. 5,616,086, which is a continuation of Ser. No. 350,507, Dec. 6, 1994, abandoned, which is a continuation of Ser. No. 101,584, Aug. 3, 1993, abandoned, which is a continuation-in-part of Ser. No. 964,916, Oct. 22, 1992, Pat. No. 5,316,297.

[51] Int. Cl.[6] ..... A63B 53/04

[52] U.S. Cl. ..... 473/291

[58] Field of Search ..... 473/325, 327, 473/330, 342, 343, 346, 350, 287, 288, 290, 291

[56] References Cited

U.S. PATENT DOCUMENTS

| | | | |
|---|---|---|---|
| 835,735 | 11/1906 | Robertson . | |
| 1,202,383 | 10/1916 | Hardman . | |
| 1,396,470 | 11/1921 | Taylor | 473/327 |
| 1,437,463 | 12/1922 | Boye | 473/342 |
| 1,575,460 | 3/1926 | Sunter . | |
| 1,720,867 | 7/1929 | Webster et al. | 473/342 |
| 2,231,847 | 2/1941 | Dickson et al. . | |
| 3,614,101 | 10/1971 | Hunter . | |
| 3,655,188 | 4/1972 | Solheim . | |
| 3,749,408 | 7/1973 | Milla . | |
| 4,058,312 | 11/1977 | Stuff et al. . | |
| 4,063,733 | 12/1977 | Benedict . | |
| 4,214,754 | 7/1980 | Zebelean . | |
| 4,438,931 | 3/1984 | Motomiya . | |
| 4,540,178 | 9/1985 | Johnson et al. . | |
| 4,632,400 | 12/1986 | Boone . | |
| 4,715,601 | 12/1987 | Lamanna . | |
| 4,784,390 | 11/1988 | Horgen . | |
| 4,809,983 | 3/1989 | Langert . | |
| 4,854,583 | 8/1989 | Kobayashi . | |
| 4,874,171 | 10/1989 | Ezaki et al. . | |
| 4,892,316 | 1/1990 | Langert et al. . | |
| 4,913,435 | 4/1990 | Kobayashi . | |
| 4,986,541 | 1/1991 | Teramoto et al. . | |
| 4,995,609 | 2/1991 | Parente et al. . | |
| 5,039,098 | 8/1991 | Pelz . | |
| 5,056,788 | 10/1991 | Katayama . | |
| 5,058,895 | 10/1991 | Igarashi . | |
| 5,060,951 | 10/1991 | Allen . | |
| 5,067,711 | 11/1991 | Parente et al. . | |
| 5,094,457 | 3/1992 | Kinoshita . | |
| 5,120,062 | 6/1992 | Scheie et al. . | |
| 5,165,688 | 11/1992 | Schmidt et al. . | |
| 5,316,297 | 5/1994 | Chappell . | |
| 5,328,176 | 7/1994 | Lo | 473/349 |

FOREIGN PATENT DOCUMENTS

| | | |
|---|---|---|
| 22763 | of 1898 | United Kingdom . |
| 22184 | of 1904 | United Kingdom . |
| 2194737 | 3/1988 | United Kingdom . |

OTHER PUBLICATIONS

"Keep Ahead of the Game", Golf Product News, vol. 3, No. 5 early Oct. 1992.

*Primary Examiner*—Steven B. Wong
*Attorney, Agent, or Firm*—Lorusso & Loud

[57] ABSTRACT

A mechanical locking device for use in attaching the shaft of a golf club to the clubhead. An angle is cast inside the hosel at the base of the hosel bore. The tip of the shaft is cut at an angle matching the angle at the bottom of the hosel bore, such that when the shaft is inserted into the bore, there is no room for lateral movement or twisting of the shaft. This device eliminates the risk that the shaft will separate from the clubhead if the epoxy cement bond should break.

5 Claims, 7 Drawing Sheets

MECHANICAL LOCKING DEVICE FOR ATTACHING A SHAFT TO A GOLF CLUB HEAD

CROSS REFERENCE TO RELATED APPLICATION

This is a divisional application of Ser. No. 08/480,556, filed Jun. 7, 1995, now U.S. Pat. No. 5,616,086, which is a continuation of Ser. No. 08/350,507, filed Dec. 6, 1994, now abandoned, which is a continuation of Ser. No. 08/101,584, filed Aug. 3, 1993, now abandoned, which is a continuation in part of Ser. No. 07/964,916, filed Oct. 22, 1992, now U.S. Pat. No. 5,316,297, the contents of which are incorporated by reference herein.

BACKGROUND OF THE INVENTION

The invention relates to golf clubs, and in particular, to a mechanical locking device for attaching the shaft portion of a golf club to the golf clubhead.

The hosel portion of a golf club is the tubular shaped member which connects the head portion of the club to the shaft portion of the club. Hosels are generally all the same length, i.e., they do not vary from club to club within a set.

Golf club irons are designed with varying degrees of loft, ranging from a minimum of about 15° for a number 1 iron to a maximum of about 60° for a wedge type club. Golf clubs also vary in length. Golf club woods are designed with varying degrees of loft ranging from about 8° to about 27°. The different degrees of loft and length help to control the trajectory and distance a golf ball is hit. With reference to FIG. 1, a golf club iron includes a blade member 2 having a toe portion 4, a top ridge 6, a bottom sole portion 8 and a heel portion 10. Extending from the heel portion region of the clubhead is a hosel portion 12 adapted to receive and be retained on a shaft member (not shown). The clubhead is provided with a substantially flat surface 16, having therein a center of percussion 18, which is the spot ideally adapted to engage a golf ball at impact, and a rear surface 20 having a perimeter 22 defining a cavity 24.

One of the problems associated with the less lofted clubs is that the size of those clubs has generally been restricted by the head weight. The less lofted iron clubheads are typically the lightest weight because they will be cut to the longest overall club length and must still be within an acceptable swing weight range. These restrictions have thus far dictated that the size of the main body of the less lofted iron clubhead remain very small volumetrically. It is desirable to increase the size of the main body of the less lofted clubs in order to make them easier to hit.

It is also desirable to provide more of an impact on the actual distribution of weight within the normal golf clubhead shape or profile. The optimum weight distribution system of an iron type golf clubhead is one in which the optimum amount of weight is positioned toward the toe area of the head on the less lofted clubs and progressively shifts toward the heel area of the head on the more lofted clubs. Placement of the weight in these positions helps eliminate the average golfer's natural tendency to hit the ball to the right when using the less lofted clubs, and hit the ball to the left when using the more lofted clubs. Efforts to move or redistribute enough weight to produce a significant impact in this area have not been completely successful because there is simply not enough material or mass contained within the main body of the conventional clubhead profile which could be moved or redistributed to effectively achieve the optimum results.

One attempt at improvement in this area has been the use of hosels of varying lengths to permit redistribution of weight within the main body of the clubhead. U.S. Pat. No. 4,715,601 to Lamanna discloses the use of hosels of varying lengths to achieve a relatively constant center of percussion for the set of lofted clubs. Lamanna discloses a design for clubs in which the hosel portions of the clubs progress in length as the loft increases, with the standard or conventional length hosel on the lowest lofted club and the longest, or longer than conventional length hosel on the highest lofted club. As the clubhead weight increases from the lower lofted irons to the higher lofted irons, the weight of the hosel portion also increases. Therefore, the center of mass is maintained at a relatively constant location in relation to the blade portion of the clubhead and the planar face of the blade portion.

Thus, Lamanna discloses that the location of center of mass remains relatively constant for all of the various lofted clubs. As mentioned above, it is desirable to have a set of golf clubs in which the center of mass shifts, with the optimum amount of weight toward the toe area on the less lofted clubs shifting progressively toward the heel on the more lofted club.

Another problem associated with the golf clubs relates to the manner in which the shaft is attached to the clubhead. In the traditional golf club, the cylindrical shaft is inserted into a cylindrical bore inside the hosel and is held in place with epoxy cement. If the epoxy cement bond breaks, the shaft moves inside the hosel, and eventually separates from the hosel.

SUMMARY OF THE INVENTION

Thus, it is an object of the present invention is to provide a set of golf clubs in which the size of the main body of the less lofted clubs is increased to make them easier to hit.

It is a further object of the present invention to provide a set of golf clubs having more of an impact on the actual distribution of weight within the normal golf clubhead shape or profile.

It is a further object of the present invention to provide a golf clubhead in which the optimum amount of weight is moved toward the toe area of the head on the less lofted clubs with the weight shifting progressively toward the heel area of the head on the more lofted clubs. This locates the center of gravity of each clubhead in an optimum position.

It is a further object of the present invention to provide a golf club which will help eliminate the average golfer's natural tendency to hit the ball to the right when using the less lofted clubs and hit the ball to the left when using the more lofted clubs.

It is a further object of the present invention to provide a strong bond between the shaft portion of the golf club and the club head.

It is a further object of the present invention to provide a means for attaching the shaft portion of the golf club to the clubhead that eliminates the risk that the shaft will separate from the hosel when the epoxy cement separates.

The invention achieves the objectives set forth above by providing a set of golf clubs which utilizes progressively longer hosel lengths for the purpose of enlarging the main body of the clubhead and/or redistributing weight within the main body of the clubhead. The hosel length progresses from a very short hosel (1⅜") on the lowest lofted iron, (the number 1 iron), to a conventional length hosel (2⅝")on the sand wedge. By reducing the length of the hosel, weight is made available that can be used to enlarge the size of the clubhead and/or redistribute weight within the main body of the clubhead. Specifically, the overall size of the number 1 iron can be increased to that of a number 3 iron, with the size of the sand wedge remaining standard and all clubs in between progressing in size in order to maintain continuity in the set. The increase in size of the main body of the clubhead makes the club easier to hit.

The extra weight may also be redistributed around the perimeter of the cavity in order to shift the center of gravity to the optimum position to maximize the distance and direction when striking a golf ball. In the less lofted clubs, the weight is redistributed toward the toe area and then moves back progressively toward the heel in the more lofted clubs.

To improve the bond between the shaft and the clubhead, an angled section is cast inside the hosel at the base of the hosel bore. The tip of the shaft is cut at an exact matching angle to fit properly within the hosel. This procedures creates a mechanical locking device. This device may be used in any golf club, regardless of whether the hosel length varies or whether it remains constant for each club in the set. The bore depth may remain constant for each club in the set, or it may vary.

The above and other features of the invention, including various novel details of construction and combination of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

In the drawing.

DESCRIPTION OF THE PREFERRED EMBODIMENT

Figure 1:
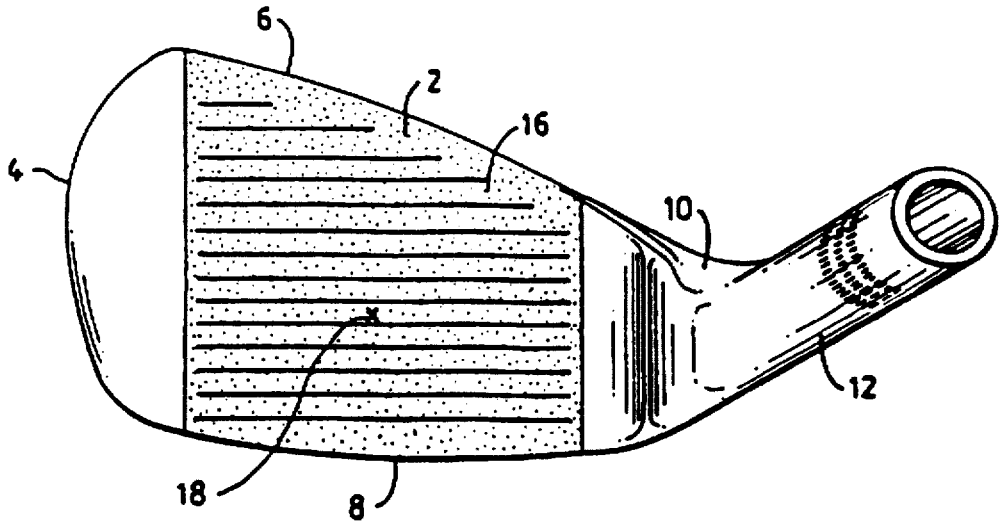
FIG. 1 shows an iron golf clubhead.
Figure 2:
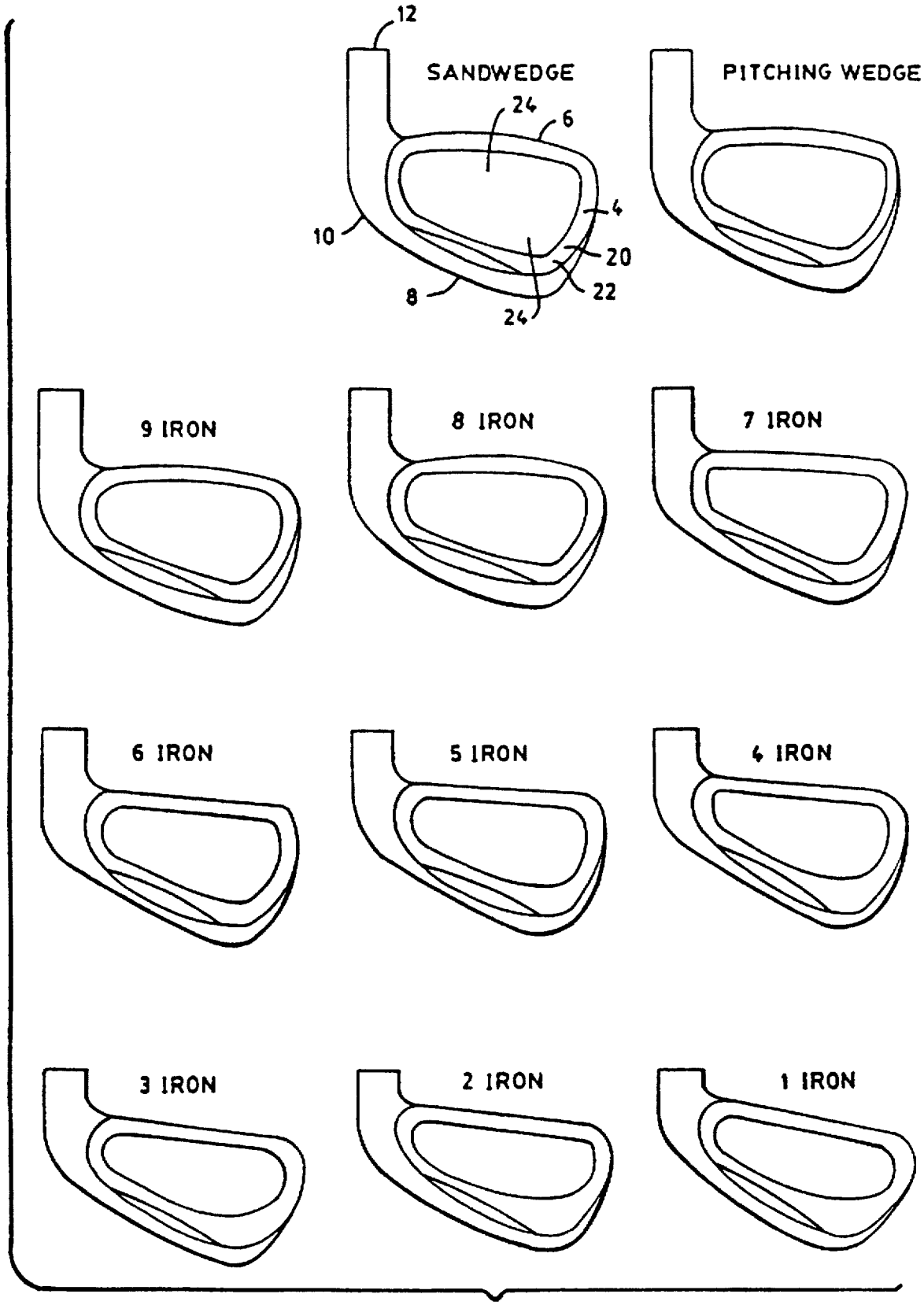
FIG. 2 shows a back view of set of golf club irons according to the invention.

Referring to the drawing, and particularly FIGS. 1 and 2, it will be seen that the illustrative golf clubhead includes a blade member 2 having a toe portion 4, a top ridge portion 6, a bottom sole portion 8 and a heel portion 10. Extending from the heel portion region of the clubhead is a hosel portion 12 adapted to receive and be retained on a shaft member 30. The clubhead is provided with a substantially flat surface 16, having therein a center of percussion 18, which is the spot ideally adapted to engage a golf ball at impact, and a rear surface 20 having a perimeter 22 defining a cavity 24.

Figure 3:
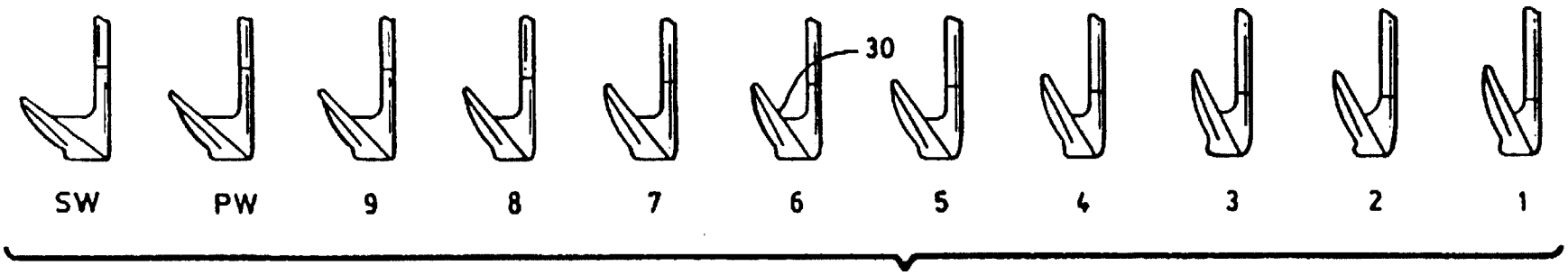
FIG. 3 shows a front view of a set of golf club irons according to the invention.
Figure 4:
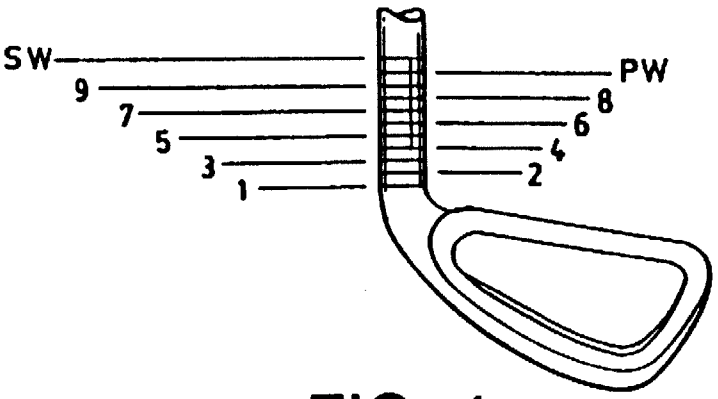
FIG. 4 shows a side view comparison of the varying hosel lengths according to the invention.

FIGS. 2–4 show a set of clubs including irons numbers 1–9 and the pitching wedge and sand wedge. The hosel length of the number 1 iron is reduced from the standard length of 2⅝" to 1⅜" and the length of each hosel progresses ⅛" per club to a conventional 2⅝" length on the sand wedge. FIG. 4 shows a side view comparison of the hosel lengths for each iron. The hosel offsets progress from 0.276" the number 1 iron to 0.076" the sand wedge, thereby giving the appearance of a straight or conventional blade on the short irons.

The leading edge 30 of the clubhead is straight or without toe to heel radius. The leading edge 30 may be radiused or rolled in the direction from the bottom of the face to the sole. There is no indentation where the leading edge blends into the hosel from the number 8 iron through the sand wedge.

In a first embodiment, the weight made available from reducing the size of the hosel 12 is used to enlarge the size of the clubhead. For example, the overall size of the number 1 iron is increased to that of a conventional number 3 iron. The overall size of the sand wedge remains conventional and all clubs in between progress in size in order to maintain continuity in the set.

Figure 6:
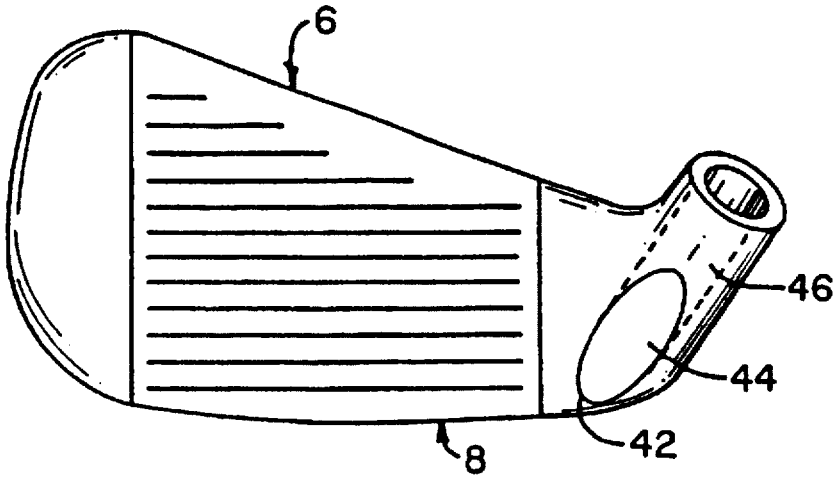
FIG. 6 shows a blind bore section of a hosel.

By reducing the length of the number 1 iron hosel from its normal length of 2⅝" to approximately 1⅜", approximately 35 grams of weight are removed which may be used to increase the size of the main body. As an example, in a typical set of golf club irons, the head weight specification increases 7 grams per club number, i.e. a normal number 1 iron head weight specification is 232 grams, the number 2 iron head weight is 239 grams, etc. By reducing the hosel length on the number 1 iron and utilizing a very thin (⅛") blind bore hosel configuration, as shown in FIG. 6, approximately 35 grams of weight can be redistributed over the main body of the clubhead. That excess weight makes it possible to produce a number 1 iron with a main body size which is volumetrically similar to that of a conventional number 3 iron. Once the main body of the iron is increased to the size of a number 3 iron, the sand wedge remains at a standard size and all club members in between are progressional.

Figure 5:
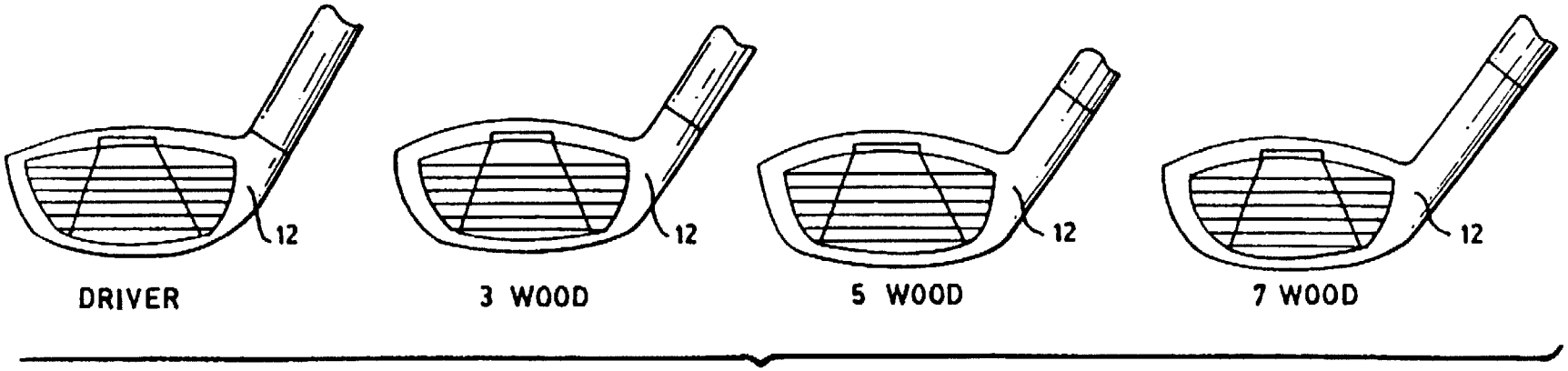
FIG. 5 shows a front view of golf club woods according to the invention.

The invention is applicable to woods as well as irons because the same features are desired on both, i.e. maximum enlargement of the main body of the less lofted clubs. FIG. 5 shows a front view of the varying hosel lengths for the driver and numbers 1, 3, 5 and 7 woods.

The physical dimensions of the progressive length hosel theory of the main body head enlargement are outlined below:

| Club No. | Approx. Overall Hosel Length | Approx. Hosel Bore Depth | Approximate Hosel Bore Configuration |
|---|---|---|---|
| | | WOODS | |
| 1 | 1⅝" | 1½" | Blind bore with shaft stopping ⅛" from sole of club |
| 3 | 2⅛" | 1½" | Blind bore with shaft stopping ⅝" from sole of club |
| 5 | 2⅝" | 1½" | Blind bore with shaft stopping 1⅛" from sole of club |
| 7 | 3⅛" | 1½" | Blind bore with shaft stopping 1⅝" from sole of club |

-continued

| Club No. | Approx. Overall Hosel Length | Approx. Hosel Bore Depth | Approximate Hosel Bore Configuration |
|---|---|---|---|
| | | | IRONS |
| 1 | 1⅜" | 1¼" | Blind bore with ⅛" solid section between bottom of hosel and sole of club |
| 2 | 1½" | 1¼" | Blind bore with ¼" solid section between bottom of hosel and sole of club |
| 3 | 1⅝" | 1¼" | Blind bore with ⅜" solid section between bottom of hosel and sole of club |
| 4 | 1¾" | 1¼" | Blind bore with ½" solid section between bottom of hosel and sole of club |
| 5 | 1⅞" | 1¼" | Blind bore with ⅝" solid section between bottom of hosel and sole of club |
| 6 | 2" | 1¼" | Blind bore with ¾" solid section between bottom of hosel and sole of club |
| 7 | 2⅛" | 1¼" | Blind bore with ⅞" solid section between bottom of hosel and sole of club |
| 8 | 2¼" | 1¼" | Blind bore with 1" solid section between bottom of hosel and sole of club |
| 9 | 2⅜" | 1¼" | Blind bore with 1⅛" solid section between bottom of hosel and sole of club |
| PW | 2½" | 1¼" | Blind bore with 1¼" solid section between bottom of hosel and sole of club |
| SW | 2⅝" | 1¼" | Blind bore with 1⅜" solid section between bottom of hosel and sole of club |

In a second embodiment, the weight available from reducing the hosel length on the less lofted clubs is used to redistribute the weight within the main body of the clubhead. As mentioned above, by reducing the hosel length to approximately 1⅜" long and utilizing a very thin ⅛" blind bore type hosel configuration, approximately 35 grams of weight can be removed from the heel section of the clubhead which can then be redistributed to the toe area of the head, thus greatly impacting the center of percussion or weight distribution of the head. The 35 grams of mass is moved to the toe area of the number 1 iron. The mass can be gradually moved back toward the heel area of the clubhead by increasing the length of the hosel by ⅛" per club until the conventional 2⅝" overall hosel length is achieved on the sand wedge.

The weight which is removed from the hosel area may be redistributed around the perimeter of the cavity. Weight may be positioned low in the sole and toward the toe on the less lofted irons and progress toward the heel on the more lofted irons. This dramatically increases the toe/heel weighting aspect within the main body of the clubhead.

Figure 9:
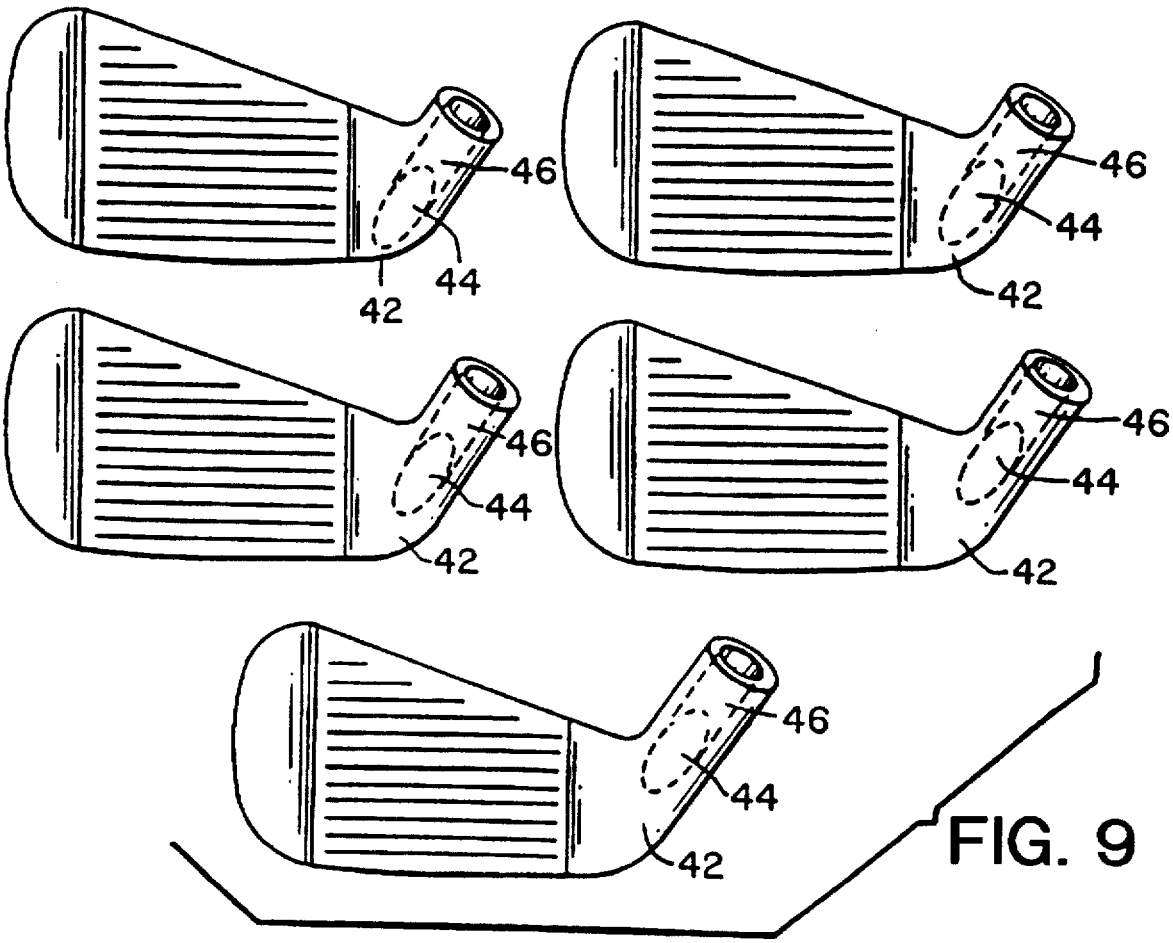
FIG. 9 shows a set of golf club irons having varying hosel lengths and constant bore depths.

As the hosel length increases by ⅛" per club number, the blind bore section at the base of the hosel will also increase or get thicker by an additional ⅛" per club number, or in other words, the hosel bore depth would remain constant at 1¼" throughout the set from the number 1 iron through the sand wedge due to the progressively increasing blind bore section 42 as shown in FIG. 9. In order to accomplish this, the tips 32 of the shafts 30 used on the short hosel clubs, i.e. the number 1 iron through the number 4 iron, are cut to an exact matching angle for proper fit. This procedure also creates a mechanical locking device thus improving the aspect of clubhead to shaft bonding.

This theory is also applicable to woods as well as irons because the same distribution of weight features are desired on both, i.e. the optimum amount of weight located toward the toe on the less lofted clubs (i.e. the driver and the number 1 iron ) progressively moved toward the heel on the more lofted clubs (number 7 wood and sand wedge).

Figure 7:
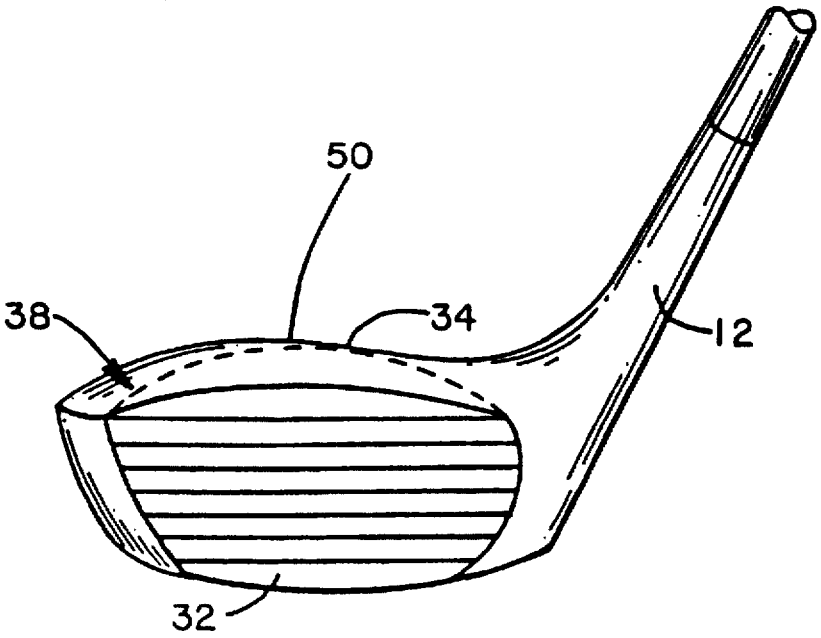
FIG. 7 shows a golf club wood having an enlarged face.

As an alternative, a wood clubhead with a conventionally sized main body can be improved by redistributing weight from the hosel 12 to the face area 32. By extending the face height, an enlarged hitting surface is created utilizing a high lip 34 across the topline of the face 38, as shown in FIG. 7. This face extension or lip 34 is highest on the less lofted clubs (or driver) progressively decreasing in size on the more lofted clubs (or 7 wood).

Figure 10:
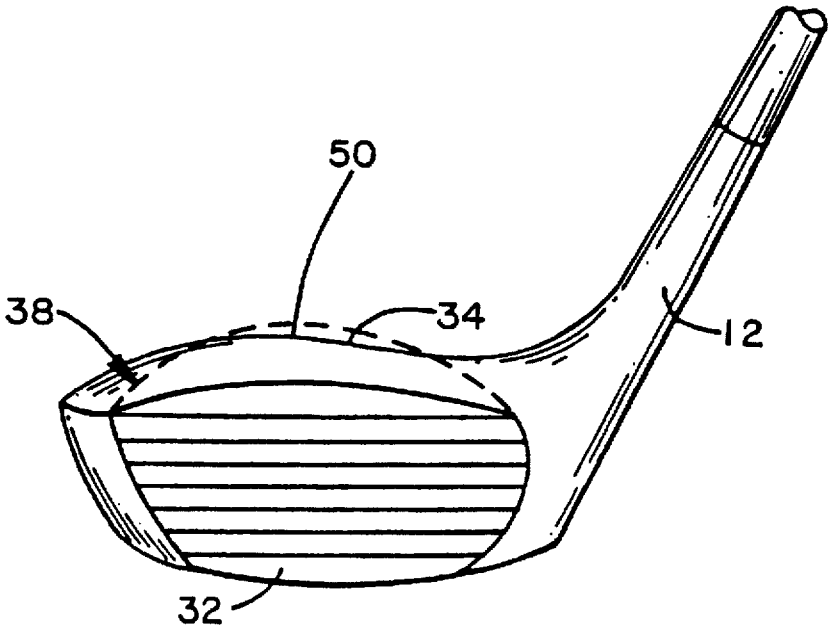
FIG. 10 shows a golf club wood having an enlarged face which extends above the crown.

The face extension may extend as high as the crown 50 of the club as shown in FIG. 7 or it may extend above the crown, as shown in FIG. 10.

The physical dimensions of the progressive length hosel theory of weight distribution are outlined below:

| Club No. | Approx. Overall Hosel Length | Approx. Hosel Bore Depth | Approximate Hosel Bore Configuration |
|---|---|---|---|
| | | | WOODS |
| 1 | 1⅝" | 1½" | Blind bore with shaft stopping ⅛" from sole of club |
| 3 | 2⅛" | 1½" | Blind bore with shaft stopping ⅝" from sole of club |
| 5 | 2⅝" | 1½" | Blind bore with shaft stopping 1⅛" from sole of club |
| 7 | 3⅛" | 1½" | Blind bore with shaft stopping 1⅝" from sole of club |
| | | | IRONS |
| 1 | 1⅜" | 1¼" | Blind bore with ⅛" solid section between bottom of hosel and sole of club |
| 2 | 1½" | 1¼" | Blind bore with ¼" solid section between bottom of hosel and sole of club |
| 3 | 1⅝" | 1¼" | Blind bore with ⅜" solid section between bottom of hosel and sole of club |
| 4 | 1¾" | 1¼" | Blind bore with ½" solid section between bottom of hosel and sole of club |
| 5 | 1⅞" | 1¼" | Blind bore with ⅝" solid section between bottom of hosel and sole of club |
| 6 | 2" | 1¼" | Blind bore with ¾" solid section between bottom of hosel and sole of club |
| 7 | 2⅛" | 1¼" | Blind bore with ⅞" solid section between bottom of hosel and sole of club |
| 8 | 2¼" | 1¼" | Blind bore with 1" solid section between bottom of hosel and sole of club |
| 9 | 2⅜" | 1¼" | Blind bore with 1⅛" solid section between bottom of hosel and sole of club |
| PW | 2½" | 1¼" | Blind bore with 1¼" solid section between bottom of hosel and sole of club |
| SW | 2⅝" | 1¼" | Blind bore with 1⅜" solid section between bottom of hosel and sole of club |

In a third embodiment, the weight made from reducing the length of the hosel is used both to increase the size of the clubheads and to shift the weight toward the toe on the less lofted clubs and toward the heel on the highest lofted clubs.

The physical dimensions of the clubheads embodying those features are outlined below:

IRONS

| Club No. | Loft | Hosel Length (approx) | Hosel Offset (approx) | Blade Length (approx) | Toe Height (approx) | Heel Height (approx) | Finished Head Wt. (approx) |
|---|---|---|---|---|---|---|---|
| 1 | 14–16° | 1.375" | 0.276" | 2.875" | 2.063" | 1.000" | 227 g |
| 2 | 17–19° | 1.500" | 0.256" | 2.875" | 2.094" | 1.031" | 234 g |
| 3 | 20–22° | 1.625" | 0.236" | 2.875" | 2.125" | 1.063" | 241 g |
| 4 | 23–25° | 1.750" | 0.216" | 2.875" | 2.156" | 1.094" | 248 g |
| 5 | 27–29° | 1.875" | 0.196" | 2.875" | 2.188" | 1.125" | 255 g |
| 6 | 31–33° | 2.000" | 0.175" | 2.875" | 2.219" | 1.156" | 262 g |
| 7 | 35–37° | 2.125" | 0.156" | 2.875" | 2.250" | 1.188" | 269 g |
| 8 | 39–41° | 2.250" | 0.136" | 2.875" | 2.281" | 1.219" | 276 g |
| 9 | 43–45° | 2.375" | 0.116" | 2.875" | 2.313" | 1.250" | 283 g |
| PW | 49–51° | 2.500" | 0.096" | 2.875" | 2.344" | 1.281" | 290 g |
| SW | 54–56° | 2.625" | 0.076" | 2.875" | 2.344" | 1.313" | 297 g |

Hosel Bore Depth=1.25"

Hosel Bore I.D.=0.355" (bottom) to 0.364" (exit point) or tapered tip

Hosel O.D.—0.540"

Sole Radius—10"

Sole Width (center)=0.675"/#1 to 0.875"/SW

Toe Radius—3"

Top Toe Radius—0.438"

Bottom Toe Radius—0.750"

Heel Radius—0.750"

Neck Radius—0.250"

Top Line Thickness—0.220" radiused

WOODS

| Club No. | Head Weight | Lie Angle | Loft |
|---|---|---|---|
| 1 | 195 g | 54° | 9.5° or 10.5° |
| 3 | 203 g | 55° | 15° |
| 5 | 210 g | 56° | 20° |
| 7 | 217 g | 57° | 23° |

It is to be noted that the dimensions for the remaining woods follow in progression. For example, the head weight of the number 2 wood is approximately 198–199 g; the head weight of the number 4 weight is approximately 213.5 g, etc.

Figure 8:
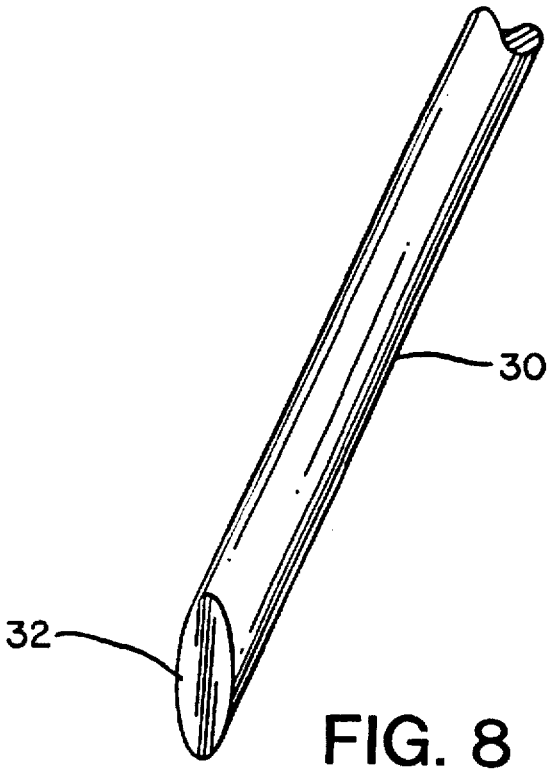
FIG. 8 shows a shaft with an end cut at an angle.

As mentioned above, the invention provides a mechanical locking device to prevent movement of the shaft in the hosel. FIG. 6 shows a blind bore section of a hosel. The oval 44 represents the angle cast inside the hosel at the base of the hosel bore. The dotted lines 46 represent the hosel bore and the area 42 between the oval 44 and the sole 8 is the blind bore section. FIG. 8 shows a shaft 30 with an end 32 cut at an angle matching the angle cast inside the hosel. When the shaft 30 is inserted into the hosel 12, no lateral movement of the shaft 30 will occur in the hosel. This procedure creates a mechanical locking device thus improving the aspect of clubhead to shaft bonding. It eliminates the risk that the shaft will separate from the clubhead if the epoxy cement bond should break.

The mechanical locking device may be used in the hosel of any golf club, regardless of whether the hosels vary in length for each club in the set or whether they remain constant.

For example, in the case of a golf club set having a constant hosel length of 2½", the blind bore depth may be kept constant at 1¼" and the bore section kept constant at 1¼" for all or some of the clubs in the set.

It is to be understood that the bore depth may be increased by decreasing the blind bore section and the bore depth may be decreased by increasing the blind bore section. The locking device may be used in golf club irons as well as golf club woods.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A set of golf club irons, each of the golf club irons in the set having a head portion with a toe area and a heel area, and a hosel portion connecting the head portion to a shaft portion, the set comprising at least a first golf club iron and at least a second golf club iron, with the head portion of the first golf club iron having a loft less than a loft of the head portion of the second golf club iron, wherein the length of the hosel of the first golf club iron is less than the length of the of the hosel of the second golf club iron, and a location of a center of percussion is not uniform for the first and second golf club irons situated toward the toe area on the first golf club iron, and situated less toward the toe area and more toward the heel area on the second golf club iron, and the comparative size of the head portions of the clubs increases as the loft of the head portion increases.

2. A set of golf club woods, each of the golf club woods in the set having a head portion with a toe area and a heel area, and a hosel connecting the head portion to a shaft portion, the set comprising at least a first golf club wood and at least a second golf club wood, with the head portion of the first golf club wood having a loft less than a loft of the head portion of the second golf club wood, wherein the length of the hosel of the first golf club wood is less than the length of the of the hosel of the second golf club wood, and a location of a center of percussion is not uniform for the first and second golf club woods situated toward the toe area on the first golf club wood, and situated less toward the toe area and more toward the heel area on the second golf club wood, and at least one of the golf club woods in the set comprises a face extending from at least as high as the highest point on the head portion.

3. The set of golf club woods of claim 2 wherein each of the golf club woods in the set comprises a face extending at least as high as a highest point on the head portion, with the face extending highest on the least lofted club and progressively decreasing in size as the loft increases.

4. The set of golf club woods of claim 3 wherein at least one of the golf club woods in the set comprises a face extending higher than a highest point on the head portion.

5. The set of golf club woods of claim 2 wherein each of the golf club woods in the set comprises a face extending higher than a highest point on the head portion, with the face extension highest on the least lofted club and progressively decreasing in size as the loft increases.

* * * * *